United States Patent [19]

Kato et al.

[11] Patent Number: 4,806,976

[45] Date of Patent: Feb. 21, 1989

[54] COPY APPARATUS WITH PATTERN WRITING CAPABILITY

[75] Inventors: Akio Kato; Keiji Nakatani, both of Toyokawa; Kanji Wada; Kaoru Hashimoto, both of Aichi; Kadotaro Nishimori; Masahiro Higaki, both of Toyokawa, all of Japan

[73] Assignee: Minolta Camera Kabushiki Kaisha, Osaka, Japan

[21] Appl. No.: 77,731

[22] Filed: Jul. 24, 1987

[30] Foreign Application Priority Data

Jul. 25, 1986 [JP] Japan ..... 61-175890
Aug. 14, 1986 [JP] Japan ..... 61-190935
Aug. 14, 1986 [JP] Japan ..... 61-190936

[51] Int. Cl.[4] ..... G03G 15/00

[52] U.S. Cl. ..... 355/7; 355/3 R; 355/14 R

[58] Field of Search ..... 355/3 R, 3 CH, 7, 14 R, 355/1

[56] References Cited

U.S. PATENT DOCUMENTS

| | | | |
|---|---|---|---|
| 4,256,400 | 3/1981 | Komori et al. | 355/14 |
| 4,291,341 | 9/1981 | Yajima | 358/300 |
| 4,582,417 | 4/1986 | Yagasaki et al. | 355/7 |
| 4,627,707 | 12/1986 | Tani et al. | 355/14 |
| 4,653,899 | 3/1987 | Watanabe | 355/14 |
| 4,707,109 | 11/1987 | Kanno et al. | 355/7 |
| 4,712,907 | 12/1987 | Weinberger et al. | 355/7 |

*Primary Examiner*—A. C. Prescott
*Attorney, Agent, or Firm*—Price, Gess & Ubell

[57] ABSTRACT

A copying apparatus having the capability to write optional pattern information on a copy sheet. The apparatus comprises an original glass plate, a photosensitive drum, plural devices for forming copied image of the original document on the photosensitive drum, an editor 900 for inputting arbitrary coordinates data, an eraser including an LED array, a control circuit for controlling the eraser in accordance with the input data, and a transfer device for transferring the copied image and the pattern image on the same surface of copy sheet.

11 Claims, 13 Drawing Sheets

COPY APPARATUS WITH PATTERN WRITING CAPABILITY

BACKGROUND OF THE INVENTION (1) Field of the Invention

The present invention relates to copy apparatus having the capability to write optional pattern information on a copy sheet.

(2) Prior Art

When making copies of original documents, it has become desirable in recent years to copy not only the image of the original but also combine with it underlining and other specific patterns.

In combining a pattern with an original document, for example, the aforesaid desired pattern is entered on the original document and then copied, or the desired pattern is entered on the copy, or the like. The former method, however, mars the original document while the latter method requires more time when many copies are made.

Methods for coping with this problem include, for example, entering the pattern on a transparent sheet and placing the transparency over the original document prior to making copies, but slippage between the pattern and the original document is liable to occur with this method.

SUMMARY OF THE INVENTION

A main object of the present invention is to provide a copy apparatus capable of writing optional pattern data on the copy sheet.

Another object of the invention is to provide a copy apparatus capable of copying the original document image and the optional pattern data on the surface of the same copy sheet.

In order to achieve the aforesaid objects, a copy apparatus of the present invention comprises a means for supporting an original document thereon, a means for forming a copied image of the original document on the surface of a copy sheet, a means for inputting arbitrary coordinate data, and a means for forming a pattern image in accordance with the input coordinate data on the same surface of the copy sheet.

BRIEF EXPLANATION OF THE DRAWINGS

These and other objects and features of the present invention will become apparent from the following description taken in conjunction with the preferred embodiments thereof with reference to t drawings, in which.

DESCRIPTION OF THE PREFERRED EMBODIMENTS

The present invention is hereinafter explained in accordance with the illustrated concrete embodiments.

Figure 1:
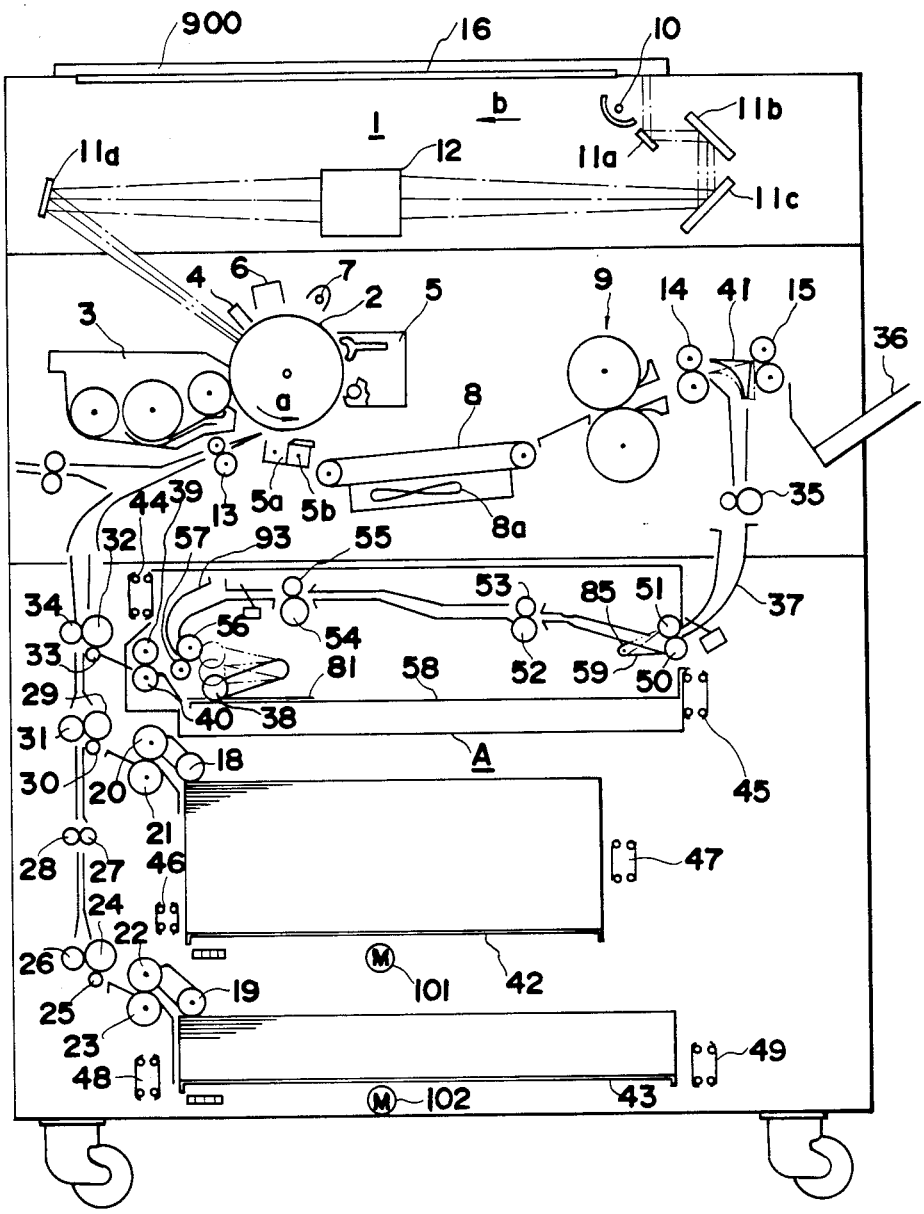
FIG. 1 is cross sectional view showing the construction of the present invention.

(1) General Structure Of The Copy Machine, With Reference To FIG. 1

The copy machine comprises, in its bottom section, copy paper storage areas 42 and 43, intermediate tray unit A, a photosensitive drum 2 at mid-level and in the center of the image-making area, and an optical system 1 in the top section, wherein composite copies or two-sided copies can be made by feeding the copy paper to the intermediate tray unit A after completion of the copying process and then refeeding said copy paper therefrom.

The aforesaid photosensitive drum 2 is rotatable in the direction indicated by the arrow, and has sequentially provided around its circumference a charging means 6, a magnetic brush-type developing apparatus 3, paper changer 5*a*, a separation charger 5*b*, a plate-type cleaning device 5, and an eraser lamp 7. Photosensitive drum 2 is uniformly charged by charger 6 via its rotation in the direction of the arrow, receives an image exposure from optical system 1, and an electrostatic image is formed thereon, said electrostatic image being developed into a toner image by the developing apparatus 3. The image interval eraser 4, to be described hereinafter, is provided in a medial position to charger 6 and developing apparatus 3 and adjacently to photosensitive drum 2. In the present embodiment the image interval eraser 4 is provided somewhat toward the charger 6 from the image exposure, but it may also be provided somewhat toward developing apparatus 3 with similar results.

Optical system 1, beneath original glass plate 16, is capable of scanning original documents in the direction indicated by arrow b, and comprises an exposure lamp 10, movable mirrors 11*a*, 11*b* and 11*c*, image formation lens 12, and stationary mirror 11*d*. Exposure lamp 10 and movable mirror 11*a* move in an integrated manner in the direction of arrow b at a speed of V/m (where m is the magnification) in relation to the peripheral speed V (which is uniform at either equal or variable magnification) of photosensitive drum 2, and movable mirrors 11*b* and 11*c* move in an integrated manner in the direction of arrow b at a speed of V/2m.

The copy paper storage area, on the other hand, comprises a top elevator-type storage tray 42 and a bottom elevator-type storage tray 43, and the copy paper stored in the respective storage trays is fed upward via the paper feed by actuating the top paper feed elevator motor 101 or the bottom paper feed elevator motor 102. The degree to which the fed copy paper rises detected as the number of revolutions of motors 101 and 102 by means of pulse disks (not shown in the drawings) connected to motors 102 and 102, respectively, and which is input to the first CPU 621 described hereafter. Also, storage trays 42 and 43 are removable from the front of the copy machine itself via tracks 42 and 43 and tracks 48 and 49, respectively.

Copy paper in storage tray 42 or paper in storage tray 43 is selectively fed sheet by sheet to guide rollers 20 and 21 via the rotation of paper roller 19 or guide rollers 22 and 23 via the rotation of paper roller 19, respectively, and then fed by feed rollers 29, 30 and 31 or feed rollers 24, 25 and 26 to rollers 32 and 34 and rollers 27 and 28, then to timing roller set 13.

After the edge of the copy paper stops at the timing roller set 13, it is synchronously delivered to the transfer area with the image formed on the aforesaid photosensitive drum 2, whereupon the toner image is transferred via the discharge from transfer charger 5*a* and the paper is separated from the surface of photosensitive drum 2 via the discharge from the separation charger 5*b*, and is then fed to a fixing device 9 by means of a feed belt 8 which has an air suction means 8*a* provided thereto, and said toner image then undergoes a heat-fixing process.

Feed roller set 14 and discharge roller set 15 are provided immediately behind the exit to fixing device 9 and lever 41 is provided therebetween for the purpose of switching the copy paper feed path. If the copy paper is discharged at this time, lever 41 is set in the position shown by the dotted line in FIG. 1, and the copy paper which is output from the fixing device 9 is discharged to tray 36 from discharge roller set 15. When composite copies or two-sided copies are made (the process is described in detail hereinafter), lever 41 is set in the position shown by the solid lines in FIG. 1, and the copy paper sent from the feed roller 35 and over the guide plate 37 to the intermediate tray unit A hereinafter described.

On the other hand, after the transfer, photosensitive drum 2 has the residual toner removed therefrom by means of cleaning device 5, and the residual electric charge removed therefrom by means the illumination emitted by eraser lamp 7, whereupon the process is ready for subsequent copying.

A brief explanation of the structure of intermediate tray unit A follows.

Intermediate tray unit A comprises a switching block, a feed block, a reversal block, an intermediate tray, a paper refeed block, and an intermediate tray 58, which together form an integrated unit having both ends supported by tracks 44 and 45 and which is removable from the front of the copy machine, i.e., in a direction perpendicular to the feed path of the copy paper.

The switching block comprises feed rollers 50 and 51 and switching lever 59. Said switching block is not mounted to the intermediate tray unit A, but rather is mounted to the body of the copy machine.

The feed block comprises feed rollers 52, 53, 54 and 55 and a guide plate.

The reversal block comprises reversal feed rollers 56 and 57 and reversal guide 93, and performs the function of inverting the copy paper delivered from the feed block and feeding it to intermediate tray 58.

The refeed block comprises a holder, a paper refeed roller 38, guide rollers 39 and 40 and a guide plate, the purpose of said refeed block being to refeed sheet by sheet the copy paper deposited in intermediate tray 58.

When making composite or two-sided copies, either of the operation mode selection keys 303 or 304 on operation panel 300 is pushed and either of the copying modes is selected, the aforesaid switching lever 41 is switched to the position shown by the solid lines in FIG. 1, and the copy paper which has been copied on one side or one section is fed from feed roller 35 to feed rollers 50 and 51 guided by guide plate 37.

When in the composite copy mode, the aforesaid switching lever 59 is set in the position shown by the dotted lines in FIG. 1, and the copy paper, immediately after transiting feed rollers 50 and 51, is guided by the bottom of lever 59 and fed directly to the intermediate tray 58 with the side not receiving the copy image being face down. Then, the copy paper in intermediate tray 58 is refed in the same manner as the two-sided copy operation via the clockwise rotation of refeed roller 38.

When in the two-side copy mode, the switching lever 59, which rotates freely about axis 85, is set in the position indicated by the solid lines in FIG. 1, and copy paper is fed to the feed block guided by the upper surface of lever 59, and is then guided by the guide plate and fed by feed rollers 52, 53, 54 and 55 to the mid-left side in FIG. 1, where it is inverted by reversal feed rollers 56 and 57 and reversal guide 93 so as to deliver it to intermediate tray 58 with the side not receiving the copy image being face up. The copy paper in the intermediate tray 58 is then refed sheet by sheet via the clockwise rotation of the refeed roller 38.

The refed copy paper is guided by guide rollers 39 and 40 through the aforesaid feed rollers 32, 33 and 34 to timing roller set 13, at which point the composite and two-sided copies are made in the same manner as for the normal copy process. Refeed roller 38 can swing to adopt any of three positions; when copy paper is fed to intermediate tray 58, the roller is positioned at either the top or intermediate position, and during paper refeeding the roller makes appropriate pressure contact with the copy paper stacked in intermediate tray 58.

Figure 2:
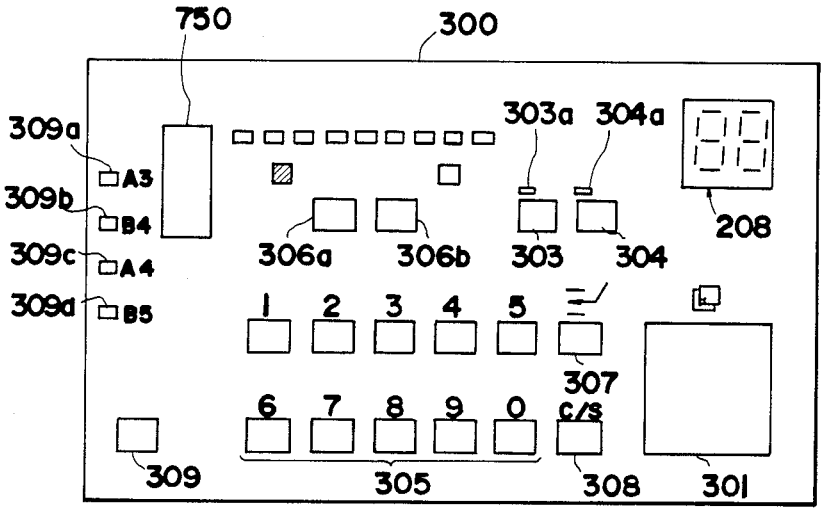
FIG. 2 is a plan view showing the exterior of operation panel of the copy apparatus.

FIG. 2 is an explanatory drawing showing a part of the operation panel of the aforesaid copy machine.

The keys shown in the drawing comprise a print key 301, a paper feed selection key 309 and the paper feed indicators 309*a* to 309*d*, ten numerical input keys 305, an interrupt key 307, a clear/stop key 308, density setting keys 306*a* and 306*b*, a two-side mode key 303 and indicator key 303*a*, a composite mode key 304 and indicator key 304*a*, a numerical indicator 208, an indicator 750 showing the selected feed paper volume and remaining sheet capacity, and the like.

Figure 3:
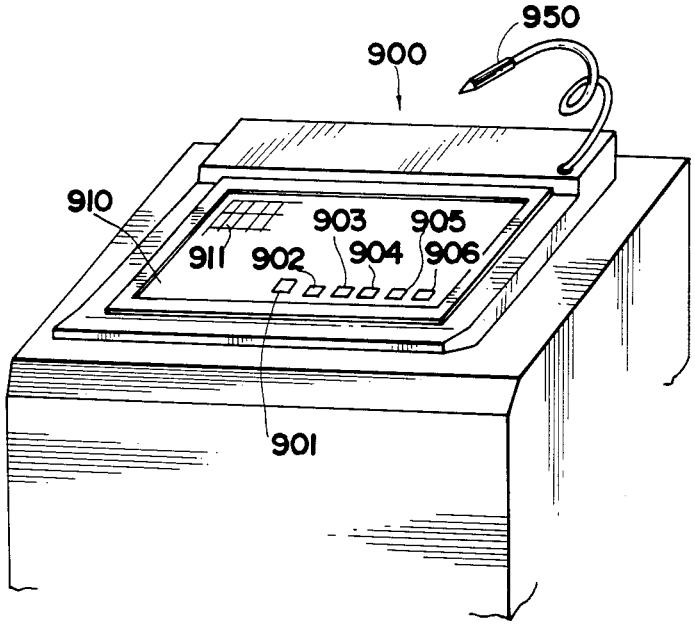
FIG. 3 is a perspective illustration of the editor.

FIG. 3 shows the editor 900 provided on the top face of the original document platen 16.

Editor 900 provides a tablet 910 and keys 901 to 906.

Tablet 910 provides numerous resistance wires 911 provided at 1 mm intervals in both the X and Y axial directions so that resistance values which determine any selected X and Y coordinate are detected when arbitrary points on the tablet are pressed and thus short-circuiting the resistance wires. The coordinates of the pressed points are specified via these resistance values. Accordingly, when inputting the X and Y coordinate data for specified points of an original document, said original document is place upon tablet 910 and the specified points are pressed. In the present embodiment, the pressing of said specified points is performed using a stylus 950.

Keys 901 to 906 are, in order, an erase key, trimming key, write mode key, clear key, all-clear key, and composite mode cancellation key.

Erase key 901 designates the elimination of the image within a specified region of the original document, and trimming key 902 designates the elimination of the image outside a specified region of the original document. Write mode key 903 designates the the mode for writing arbitrary patterns, and when the write mode key is pushed, the copy machine sets itself to the composite mode; clear key 904 eliminates the coordinate or pattern input. The all-clear key 905 eliminates all the aforesaid designations. Composite mode cancellation key 906 cancels the composite mode set in response to the activation of the write mode key 903.

Figure 4:
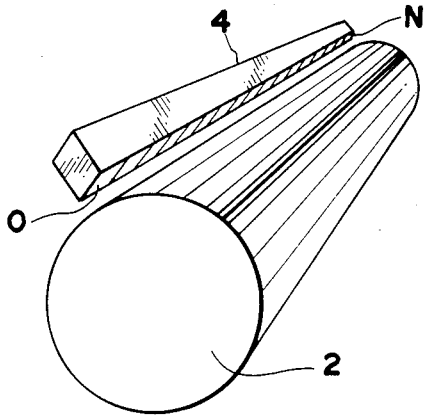
FIG. 4 is a perspective illustration showing the positional relationship of the image interval eraser unit and the photosensitive drum.
Figure 5:
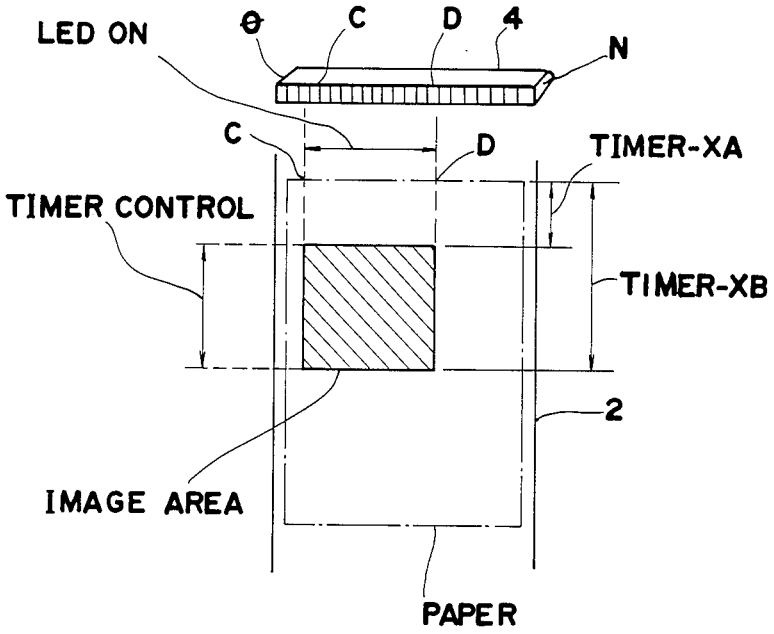
FIG. 5 is an explanatory drawing showing the relationship of the image interval eraser unit and the erasing region.

FIG. 4 is a perspective illustration showing the image interval eraser 4 provided adjacently to photosensitive drum 2, and FIG. 5 is an explanatory drawing of showing the erasure of the specified area charge on the surface of photosensitive drum 2 via image interval eraser 4.

Image interval eraser 4, as shown in the drawing, provides an LED (light emitting diode) array wherein a number (N+1) LED light emitting components are arranged in a single row, and which removes the charge of the area corresponding to the photosensitive drum 2 by means of causing certain of the LED components to selectively emit a specific amount of light; image interval eraser 4 either erases the electrostatic image of said region or it inputs a pattern.

When, for example as shown in FIG. 5 and imagining N+1 LED components marked 0 to N from the left, LED components C through D switched ON from the instant timer XA ends to the instant timer XB ends, the charge is removed within the area on photosensitive drum 2 corresponding to the shaded section on the drawing.

Figure 6:
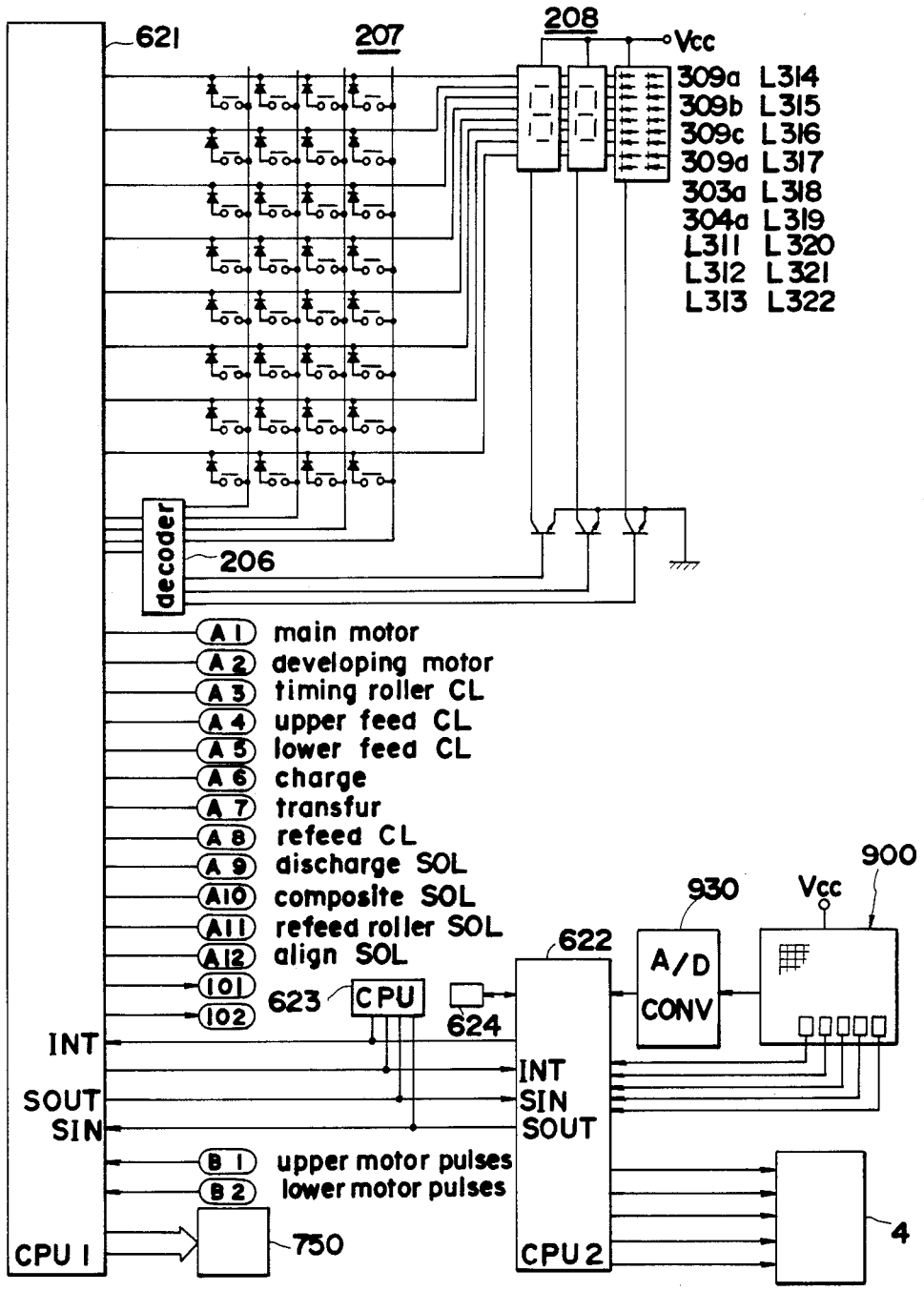
FIG. 6 is a diagram showing the control circuits of the of the copy apparatus.

An explanation of the control circuit for the copy machine of the present invention follows hereinafter according to FIG. 6.

The control circuit centrally comprises a first microcomputer 621 which controls the copy operations and a second microcomputer 622 which control the eraser and which mutually connects same.

The first CPU 621 has a switching matrix 207 connected thereto which contains various operation keys and sensors on an operation panel 300. Also, the first CPU 621 output terminals Al to A12 have a main motor, developing motor, paper feed clutches, paper refeed clutch, and levers 41 and 51 switching solenoids connected thereto, and the ON-OFF status of these components is controlled via the signals from the aforesaid switching matrix 207. Output terminals 101 and 102 have the elevator actuation motors for top storage section 42 and bottom storage section 43 connected thereto. Motor pulses generated via the rotation of the elevator motors for top storage section 42 and bottom storage section 43 are input to the first CPU 621 input terminals B1 and B2, respectively, the remaining copy paper volume being determined by the total number of said pulses, and which is then output to indicator 750. The first CPU 621 has various light emitting components (LED) such as the copy number indicator 208 connected thereto via decoder 206 so as to control the ON-OFF status of said lighting components.

The second CPU 622 inputs coordinate data from editor 900 via the A/D converter 930, and also inputs signals from the keys 901 to 906 of editor 900. In the write mode, the second CPU 622 forms pattern tables for the purpose of entering specified patterns on the photosensitive member in accordance with the coordinate data input from the editor, and in the erase and trimming modes, also, an erase table is formed for the purpose of removing the charge from a specified area of the surface of the photosensitive member in accordance with the coordinate data from the editor 900. The second CPU 622 responds to the activation of the write mode key 903, and outputs a signal specifying the composite copy mode to the first CPU 621, i.e., when the write mode key 903 is pressed ON, the composite copy mode is set without pressing the composite mode key 904. Item 4 is the eraser activation control circuit which controls the ON-OFF status of each LED of the eraser by means of the pattern or eraser tables.

The direct current motor actuation control for optical system scanning, the stepping motor actuation control for lens mobility, and the aforesaid optical system 1 fixed position switch, timing switch, and the like are connected to the third CPU 623. Item 624 is the memory.

Figure 7:
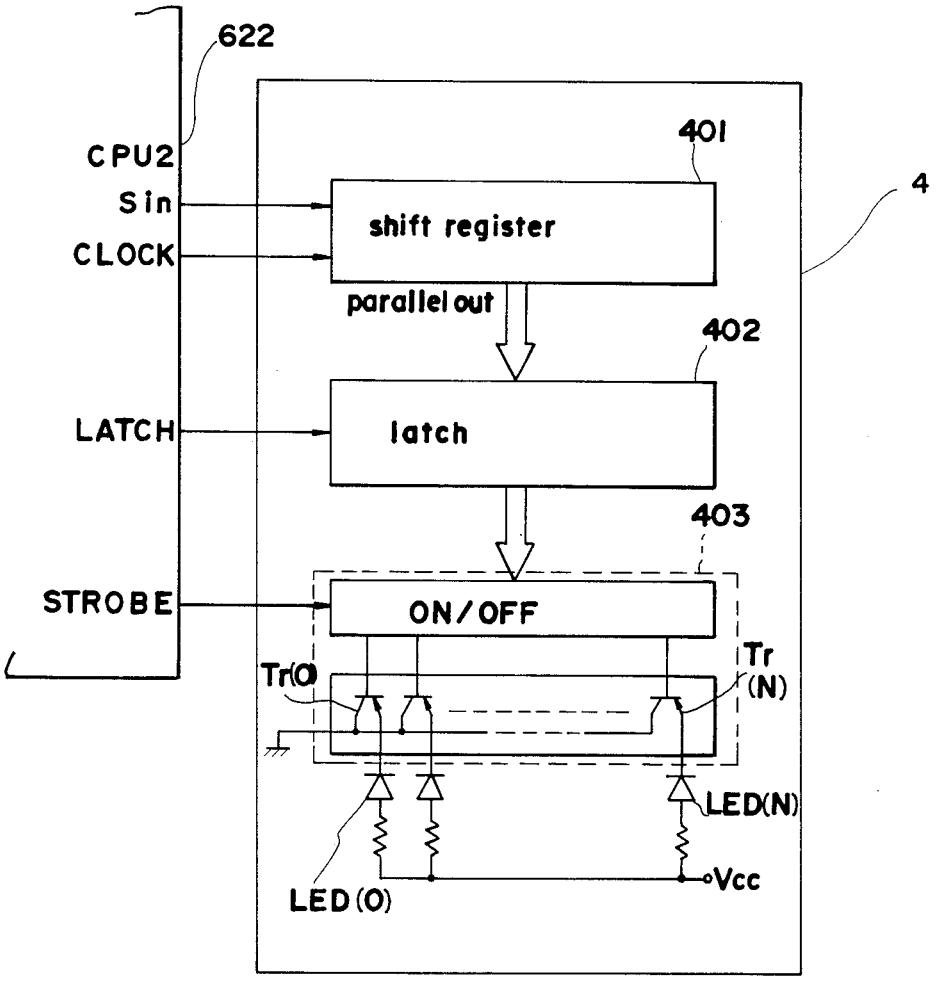
FIG. 7 is a detailed circuit diagram showing the eraser drive circuits.
Figure 8A:
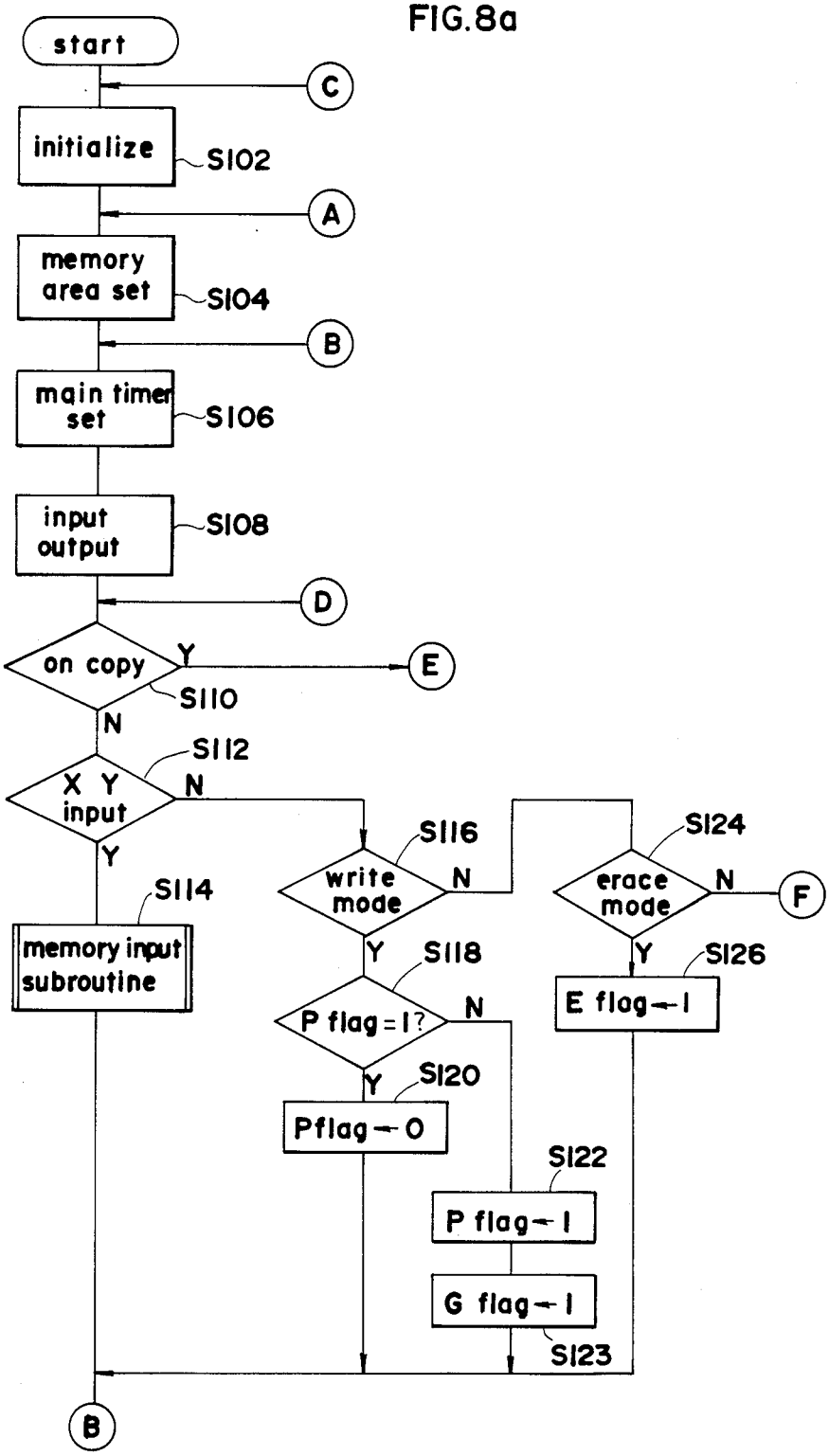
FIGS. 8*a* to 8*c* are flow charts showing the second CPU controls.
Figure 8B:
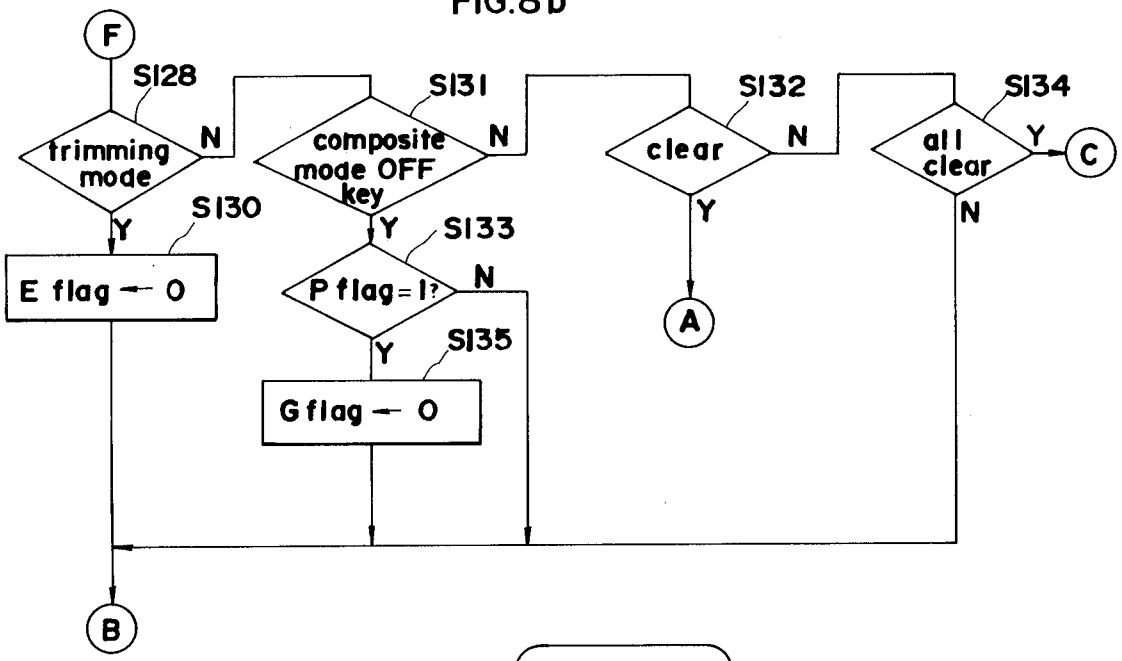
Figure 8D:
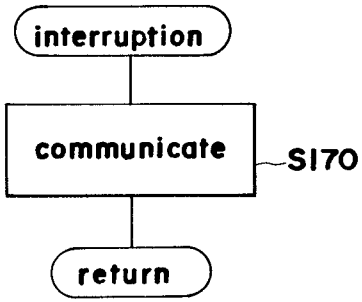
Figure 8C:
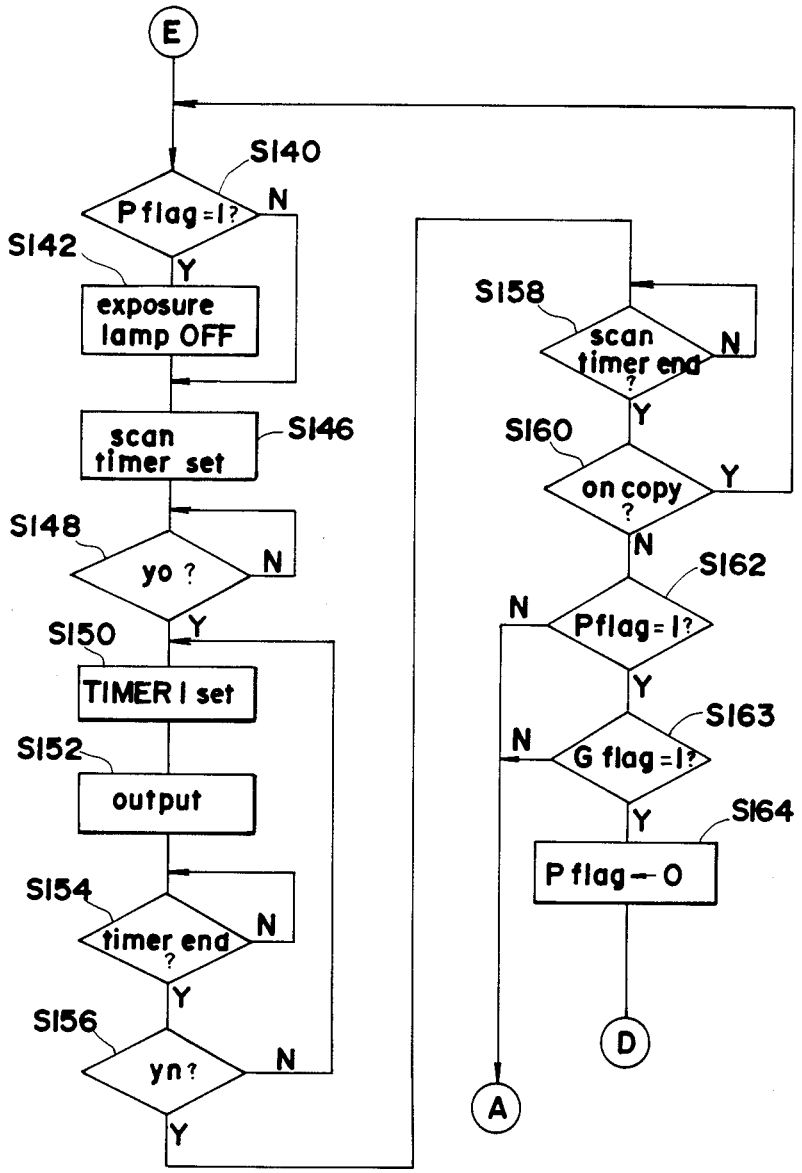

FIG. 7 is a circuit diagram showing the details of the eraser 4 actuation control circuit.

The actuation control circuit comprises a shift register 401, a latch 402, and a driver 403, said circuit controlling these components by the signals sent from the second CPU 622, and controlling the ON-OFF status of each actuation transistor Tr(0) to Tr(N).

The operation of the present embodiment is hereinafter explained.

Figure 9:
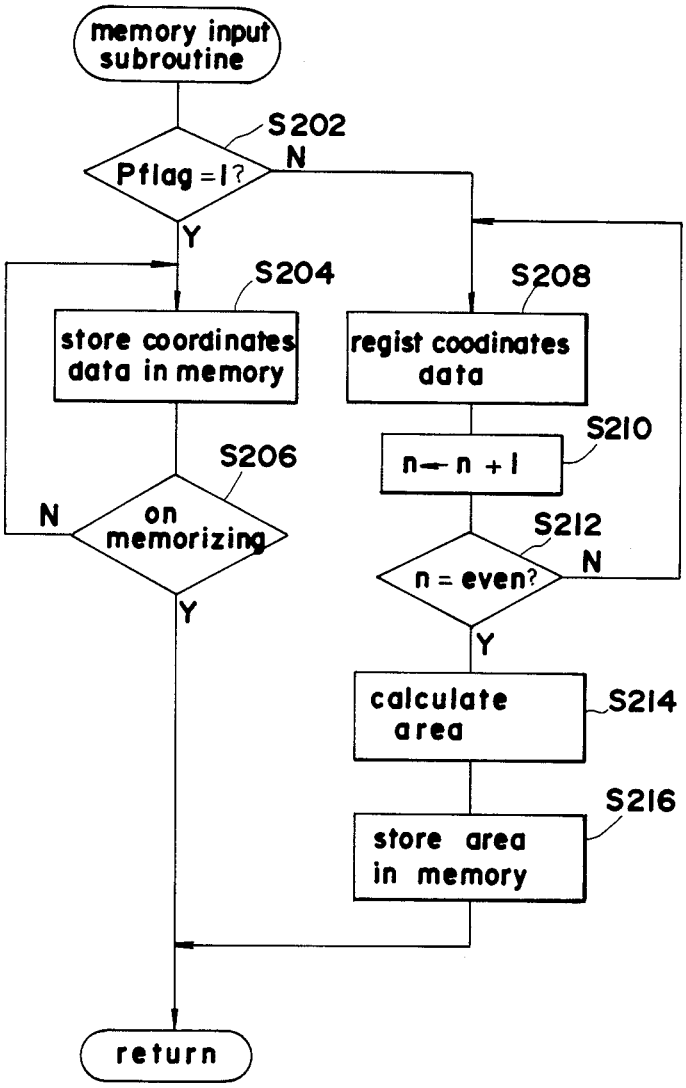
FIG. 9 is a flow chart showing the details of the memory input subroutine.

FIGS. 8 and 9 are flow charts showing the second CPU 622 control (conversion of pattern information). An explanation of the first CPU 621 controls (copy operations, temperature controls, optical system controls and the like) is omitted because such controls are disclosed in U.S. Pat. Nos. 4,543,643, 4,575,222, and U.S. Ser. No. 883,144 (filed July 8, 1986).

The second CPU 622, as shown in the drawing, initializes when, for example, the process is started by turning on the power source. For example, in the initialization state the value of the counter which counts the coordinate specification frequency is set at zero (0), or each flag is reset or each memory is cleared. Next, the coordinate data and other memory areas are set (S104). Thereafter, the main timer which protects the CPU from abnormalities is set (S106), and the routine progresses to step S102 where the input/output are activated.

Then, in step S110, it is determined whether or not copy making is in progress; if the copy making process is underway the routine continues to step S140, or if the copy process is not underway the routine continues to step S112.

In step S112, the presence or lack of coordinate signal input from the tablet 910 is determined.

When it is determined that there has been input in step S112, the routine continues to step S114 where the aforesaid input (X,Y) coordinate signals are converted to the data tables used to control the ON/OFF status of the LED components and which, thereafter, are stored in memory 624 and the routine returns to step S106. Details of the storage process are explained later with reference to FIG. 9.

When it is determined that there has not been input in step S112, the routine continues to step S116 and subsequent steps.

In step S116, the presence or lack of write mode key 903 input (whether or not the key has been depressed) is determined. When there is input, the P flag (step S118) is analyzed; if the P flag is already set it is then reset (S120), or conversely, if the P flag is already reset it is then set (S122) and the G flag is set (S123) and, thereafter, the routine returns to step S106. When there has been no input the routine progresses from step S116 to step S124.

In step S124, the presence or lack of eraser key 901 input is determined. If input has been made, the E flag (erase flag) is set (S126) and the routine returns to step S106. If there has not been input, the routine progresses to step S128.

In step S128, the presence or lack of trimming key 902 input is determined. If input has been made, the E flag is reset (S130) and the routine returns to step S106. If there has not been input, the routine progresses to step S131.

In step S131, the present or lack of composite mode key 906 input is determined. If input has been made, the P flag is analyzed (S133); if the P flag is set, then the G flag is reset (G flag=0) and the composite copy mode is cancelled (S135). If there has been no input, the routine continues to step S132.

In step S132, the presence or lack of clear key 904 input is determined; if input has been made, the routine returns to step S104 and if there has not been input, the routine continues to step S134.

In step S134, the presence or lack of all-clear key 905 input is determined. If input has been made, the routine returns to the aforesaid step S102; if there has been no input, the routine returns to the aforesaid step S106.

As described in the previously mentioned steps S112 through S134, the coordinate data and/or pattern data used for editing the copy is stored in memory 624.

When it is determined that the copy process is underway in the aforesaid step S110, the routine progresses to step S140 and subsequent steps.

First, the P flag is analyzed (S140).

When the P flag is already set, the routine progresses to step S142 and the exposure lamp is switched OFF in order to input the pattern data (the write mode key has been depressed), whereupon, said pattern is electrically stored as coordinates corresponding to the points pressed by stylus 950, then the routine continues to step S146.

When the P flag is reset, the routine continues directly to step S146 in order to erase within the region specified by the input coordinate data (E flag=1) or erase outside the specified region (E flag=0).

The scanning timer is set in step S146.

In step S148, whether the leading edge of the image has reached ($Y=Y_0$) is determined. This is determined via a specific position signal from the scanning system.

Steps S150 to S156 are the steps for controlling the ON/OFF status of each LED component for eraser 4 via based on the aforesaid table derived from the input data.

When the P flag equals one (1), for example, the ON/OFF status of each LED component is controlled based on the table prepared in the previous step S114. In concrete terms, the timer 1 is set in step S150, said timer regulating the time for a unit of emitted light of the LED component, each LED component being switched ON based on the aforesaid data until such time as said timer 1 ends (S154), or is switched OFF (S152). The operation continues until the controls reach the terminating edge of the image ($Y=Y_n$) in step S156 based on the aforementioned table. The electrical input of a specific pattern is accomplished via this process.

When the P flag equals zero (0), erasure or trimming of the specified area is controlled in the same manner as previously described, i.e., the area within the region or outside the region is erased by means of activating or deactivating the LED components which correspond to the specified region.

The routine then continues to step S158 wherein a determination is made as to whether or not the copy process is in progress while awaiting the end of the scanning timer set previously in step S146. This step assumes a multiple copy process, and when the copy process is in progress, the routine returns to step S140, and when the copy process is not in progress, the routine continues to step S162.

In step S162, the P flag is analyzed. This check allows a determination as to whether the immediately previous copy operation was an original copy or a created image pattern.

When the P flag equals one (1) and the immediately previous copy operation was of a created image pattern, the routine continues to step S163 where it is determined whether or not the G flag is set. When the G flag is not set, the routine returns to the previous step S104 and the next operation is performed. When the G flag is set it indicates a composite copy operation, the routine continues to step S164 where the P flag is vacated and the routine returns to the previous step S110, and the original copy (a composite copy with a created image pattern overlay) process starts.

When the P flag equals zero (0), the routine returns to the previous step S104 because the immediately preceding operation was an original copy, and the cycle of operation begins.

During this time, communication with the CPU controlling the copy machines copy operations and the like is performed via the interrupt (S170).

FIG. 9 is a flow chart showing details of the aforesaid step S114 process.

First, the P flag is analyzed in step S202.

When the P flag equals one (1), the routine continues to step S204 where the coordinate data input from the tablet is stored in memory while during an intermittent period of said input (S206). Thus, the pattern recording table is prepared.

Figure 10:
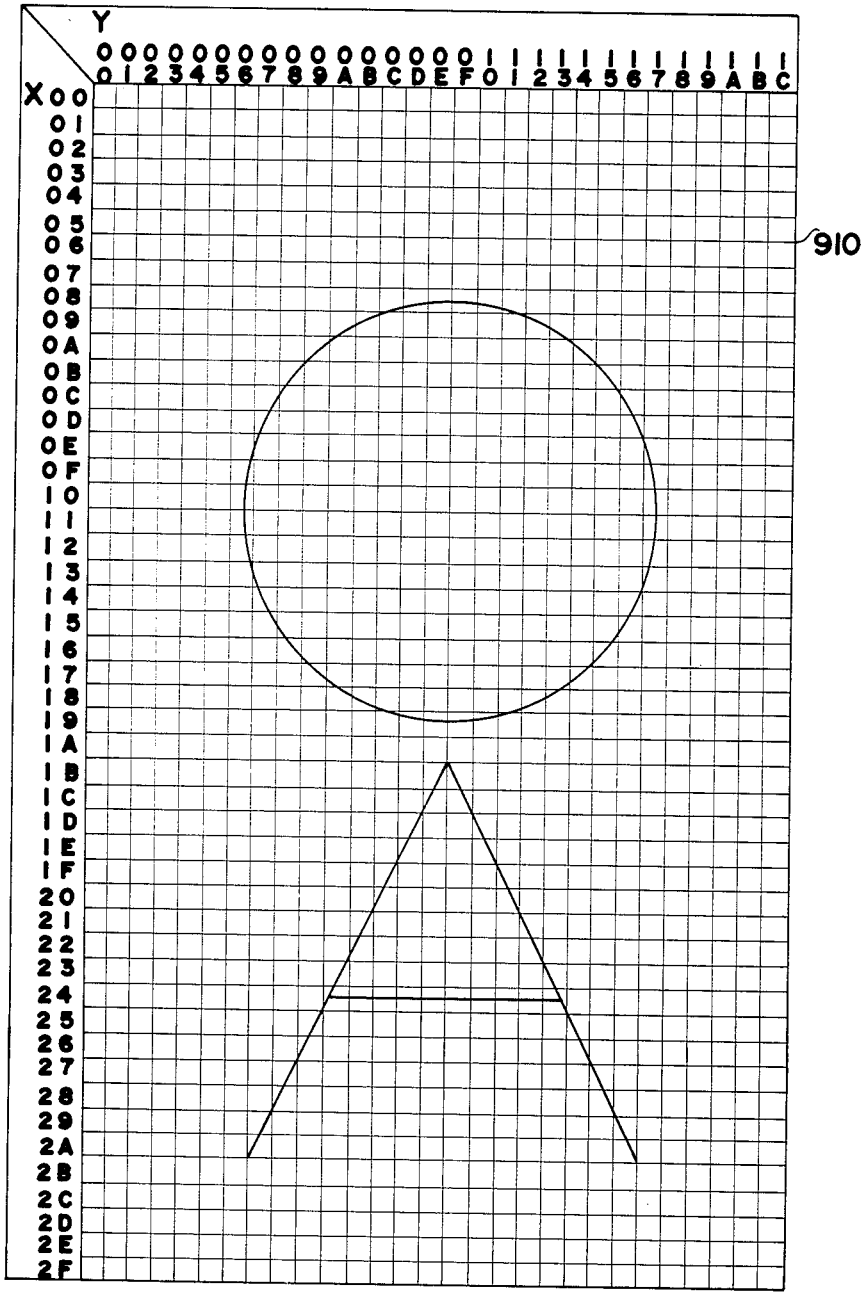
FIG. 10 is an illustration showing the pattern input mode to the editor using a stylus.

When, for example, the letters "0" and "A" are written on the tablet 910 using the stylus 950 as shown in FIG. 10, a pattern table shown in Tables 1*a* to 1*d* is formed in memory 624.

TABLE 1a

| MEMORY ADDRESS | | | | COORDINATE X | | COORDINATE Y | | DATA |
|---|---|---|---|---|---|---|---|---|
| F | 0 | 0 | 0 | 0 | 0 | 0 | 0 | 0000 0000 |
| F | 0 | 0 | 1 | 0 | 8 | 0 | 0 | 0000 0000 |
| F | 0 | 0 | 2 | 1 | 0 | 0 | 0 | 0000 0000 |
| F | 0 | 0 | 3 | 1 | 8 | 0 | 0 | 0000 0000 |
| F | 0 | 0 | 4 | 2 | 0 | 0 | 0 | 0000 0000 |
| F | 0 | 0 | 5 | 2 | 8 | 0 | 0 | 0000 0000 |
| F | 0 | 0 | 6 | 0 | 0 | 0 | 1 | 0000 0000 |
| F | 0 | 0 | 7 | 0 | 8 | 0 | 1 | 0000 0000 |
| F | 0 | 0 | 8 | 1 | 0 | 0 | 1 | 0000 0000 |
| F | 0 | 0 | 9 | 1 | 8 | 0 | 1 | 0000 0000 |
| F | 0 | 0 | A | 2 | 0 | 0 | 1 | 0000 0000 |
| F | 0 | 0 | B | 2 | 8 | 0 | 1 | 0000 0000 |
| F | 0 | 0 | C | 0 | 0 | 0 | 2 | 0000 0000 |
| F | 0 | 0 | D | 0 | 8 | 0 | 2 | 0000 0000 |
| F | 0 | 0 | E | 1 | 0 | 0 | 2 | 0000 0000 |
| F | 0 | 0 | F | 1 | 8 | 0 | 2 | 0000 0000 |
| F | 0 | 1 | 0 | 2 | 0 | 0 | 2 | 0000 0000 |
| F | 0 | 1 | 1 | 2 | 8 | 0 | 2 | 0000 0000 |
| F | 0 | 1 | 2 | 0 | 0 | 0 | 3 | 0000 0000 |
| F | 0 | 1 | 3 | 0 | 8 | 0 | 3 | 0000 0000 |
| F | 0 | 1 | 4 | 1 | 0 | 0 | 3 | 0000 0000 |
| F | 0 | 1 | 5 | 1 | 8 | 0 | 3 | 0000 0000 |

TABLE 1a-continued

| MEMORY ADDRESS | | | | COORDINATE X | | COORDINATE Y | | DATA |
|---|---|---|---|---|---|---|---|---|
| F | 0 | 1 | 6 | 2 | 0 | 0 | 3 | 0000 0000 |
| F | 0 | 1 | 7 | 2 | 8 | 0 | 3 | 0000 0000 |
| F | 0 | 1 | 8 | 0 | 0 | 0 | 4 | 0000 0000 |
| F | 0 | 1 | 9 | 0 | 8 | 0 | 4 | 0000 0000 |
| F | 0 | 1 | A | 1 | 0 | 0 | 4 | 0000 0000 |
| F | 0 | 1 | B | 1 | 8 | 0 | 4 | 0000 0000 |
| F | 0 | 1 | C | 2 | 0 | 0 | 4 | 0000 0000 |
| F | 0 | 1 | D | 2 | 8 | 0 | 4 | 0000 0000 |
| F | 0 | 1 | E | 0 | 0 | 0 | 5 | 0000 0000 |
| F | 0 | 1 | F | 0 | 8 | 0 | 5 | 0000 0000 |
| F | 0 | 2 | 0 | 1 | 0 | 0 | 5 | 0000 0000 |
| F | 0 | 2 | 1 | 1 | 8 | 0 | 5 | 0000 0000 |
| F | 0 | 2 | 2 | 2 | 0 | 0 | 5 | 0000 0000 |
| F | 0 | 2 | 3 | 2 | 8 | 0 | 5 | 0000 0000 |
| F | 0 | 2 | 4 | 0 | 0 | 0 | 6 | 0000 0000 |
| F | 0 | 2 | 5 | 0 | 8 | 0 | 6 | 0000 0111 |
| F | 0 | 2 | 6 | 1 | 0 | 0 | 6 | 1111 0000 |
| F | 0 | 2 | 7 | 1 | 8 | 0 | 6 | 0000 0000 |
| F | 0 | 2 | 8 | 2 | 0 | 0 | 6 | 0000 0000 |
| F | 0 | 2 | 9 | 2 | 8 | 0 | 6 | 0000 0000 |
| F | 0 | 2 | A | 0 | 0 | 0 | 7 | 0000 0000 |
| F | 0 | 2 | B | 0 | 8 | 0 | 7 | 0000 1110 |
| F | 0 | 2 | C | 1 | 0 | 0 | 7 | 0001 1100 |

TABLE 1b

| MEMORY ADDRESS | | | | COORDINATE X | | COORDINATE Y | | DATA |
|---|---|---|---|---|---|---|---|---|
| F | 0 | 2 | D | 1 | 8 | 0 | 7 | 0000 0000 |
| F | 0 | 2 | E | 2 | 0 | 0 | 7 | 0000 0000 |
| F | 0 | 2 | F | 2 | 8 | 0 | 7 | 0110 0000 |
| F | 0 | 3 | 0 | 0 | 0 | 0 | 8 | 0000 0000 |
| F | 0 | 3 | 1 | 0 | 8 | 0 | 8 | 0001 1000 |
| F | 0 | 3 | 2 | 1 | 0 | 0 | 8 | 0000 0110 |
| F | 0 | 3 | 3 | 1 | 8 | 0 | 8 | 0000 0000 |
| F | 0 | 3 | 4 | 2 | 0 | 0 | 8 | 0000 0001 |
| F | 0 | 3 | 5 | 2 | 8 | 0 | 8 | 1000 0000 |
| F | 0 | 3 | 6 | 0 | 0 | 0 | 9 | 0000 0000 |
| F | 0 | 3 | 7 | 0 | 8 | 0 | 9 | 0010 0000 |
| F | 0 | 3 | 8 | 1 | 0 | 0 | 9 | 0000 0001 |
| F | 0 | 3 | 9 | 1 | 8 | 0 | 9 | 0000 0000 |
| F | 0 | 3 | A | 2 | 0 | 0 | 9 | 0000 0110 |
| F | 0 | 3 | B | 2 | 8 | 0 | 9 | 0000 0000 |
| F | 0 | 3 | C | 0 | 0 | 0 | A | 0000 0000 |
| F | 0 | 3 | D | 0 | 8 | 0 | A | 0110 0000 |
| F | 0 | 3 | E | 1 | 0 | 0 | A | 0000 0001 |
| F | 0 | 3 | F | 1 | 8 | 0 | A | 1000 0000 |
| F | 0 | 4 | 0 | 2 | 0 | 0 | A | 0001 1000 |
| F | 0 | 4 | 1 | 2 | 8 | 0 | A | 0000 0000 |
| F | 0 | 4 | 2 | 0 | 0 | 0 | B | 0000 0000 |
| F | 0 | 4 | 3 | 0 | 8 | 0 | B | 0100 0000 |
| F | 0 | 4 | 4 | 1 | 0 | 0 | B | 0000 0000 |
| F | 0 | 4 | 5 | 1 | 8 | 0 | B | 0100 0000 |
| F | 0 | 4 | 6 | 2 | 0 | 0 | B | 0110 0000 |
| F | 0 | 4 | 7 | 2 | 8 | 0 | B | 0000 0000 |
| F | 0 | 4 | 8 | 0 | 0 | 0 | C | 0000 0000 |
| F | 0 | 4 | 9 | 0 | 8 | 0 | C | 0100 0000 |
| F | 0 | 4 | A | 1 | 0 | 0 | C | 0000 0000 |
| F | 0 | 4 | B | 1 | 8 | 0 | C | 1100 0001 |
| F | 0 | 4 | C | 2 | 0 | 0 | C | 1000 1000 |
| F | 0 | 4 | D | 2 | 8 | 0 | C | 0000 0000 |
| F | 0 | 4 | E | 0 | 0 | 0 | D | 0000 0000 |
| F | 0 | 4 | F | 0 | 8 | 0 | D | 1000 0000 |
| F | 0 | 5 | 0 | 1 | 0 | 0 | D | 0000 0000 |
| F | 0 | 5 | 1 | 1 | 8 | 0 | D | 0100 0110 |
| F | 0 | 5 | 2 | 2 | 0 | 0 | D | 0000 1000 |
| F | 0 | 5 | 3 | 2 | 8 | 0 | D | 0000 0000 |
| F | 0 | 5 | 4 | 0 | 0 | 0 | E | 0000 0000 |
| F | 0 | 5 | 5 | 0 | 8 | 0 | E | 1000 0000 |
| F | 0 | 5 | 6 | 1 | 0 | 0 | E | 0000 0000 |
| F | 0 | 5 | 7 | 1 | 8 | 0 | E | 0101 1000 |
| F | 0 | 5 | 8 | 2 | 0 | 0 | E | 0000 1000 |
| F | 0 | 5 | 9 | 2 | 8 | 0 | E | 0000 0000 |

TABLE 1c

| MEMORY ADDRESS | | | | COORDINATE X | | COORDINATE Y | | DATA |
|---|---|---|---|---|---|---|---|---|
| F | 0 | 5 | A | 0 | 0 | 0 | F | 0000 0000 |
| F | 0 | 5 | B | 0 | 8 | 0 | F | 1000 0000 |
| F | 0 | 5 | C | 1 | 0 | 0 | F | 0000 0000 |
| F | 0 | 5 | D | 1 | 8 | 0 | F | 0101 1000 |
| F | 0 | 5 | E | 2 | 0 | 0 | F | 0000 1000 |
| F | 0 | 5 | F | 2 | 8 | 0 | F | 0000 0000 |
| F | 0 | 6 | 0 | 0 | 0 | 1 | 0 | 0000 0000 |
| F | 0 | 6 | 1 | 0 | 8 | 1 | 0 | 1000 0000 |
| F | 0 | 6 | 2 | 1 | 0 | 1 | 0 | 0000 0000 |
| F | 0 | 6 | 3 | 1 | 8 | 1 | 0 | 0100 0110 |
| F | 0 | 6 | 4 | 2 | 0 | 1 | 0 | 0000 1000 |
| F | 0 | 6 | 5 | 2 | 8 | 1 | 0 | 0000 0000 |
| F | 0 | 6 | 6 | 0 | 0 | 1 | 1 | 0000 0000 |
| F | 0 | 6 | 7 | 0 | 8 | 1 | 1 | 0100 0000 |
| F | 0 | 6 | 8 | 1 | 0 | 1 | 1 | 0000 0000 |
| F | 0 | 6 | 9 | 1 | 8 | 1 | 1 | 1100 0001 |
| F | 0 | 6 | A | 2 | 0 | 1 | 1 | 1000 1000 |
| F | 0 | 6 | B | 2 | 8 | 1 | 1 | 0000 0000 |
| F | 0 | 6 | C | 0 | 0 | 1 | 2 | 0000 0000 |
| F | 0 | 6 | D | 0 | 8 | 1 | 2 | 0100 0000 |
| F | 0 | 6 | E | 1 | 0 | 1 | 2 | 0000 0000 |
| F | 0 | 6 | F | 1 | 8 | 1 | 2 | 1000 0000 |
| F | 0 | 7 | 0 | 2 | 0 | 1 | 2 | 0110 1000 |
| F | 0 | 7 | 1 | 2 | 8 | 1 | 2 | 0000 0000 |
| F | 0 | 7 | 2 | 0 | 0 | 1 | 3 | 0000 0000 |
| F | 0 | 7 | 3 | 0 | 8 | 1 | 3 | 0110 0000 |
| F | 0 | 7 | 4 | 1 | 0 | 1 | 3 | 0000 0001 |
| F | 0 | 7 | 5 | 1 | 8 | 1 | 3 | 1000 0000 |
| F | 0 | 7 | 6 | 2 | 0 | 1 | 3 | 0001 1000 |
| F | 0 | 7 | 7 | 2 | 8 | 1 | 3 | 0000 0000 |
| F | 0 | 7 | 8 | 0 | 0 | 1 | 4 | 0000 0000 |
| F | 0 | 7 | 9 | 0 | 8 | 1 | 4 | 0010 0000 |
| F | 0 | 7 | A | 1 | 0 | 1 | 4 | 0000 0001 |
| F | 0 | 7 | B | 1 | 8 | 1 | 4 | 0000 0000 |
| F | 0 | 7 | C | 2 | 0 | 1 | 4 | 0000 0110 |
| F | 0 | 7 | D | 2 | 8 | 1 | 4 | 0000 0000 |
| F | 0 | 7 | E | 0 | 0 | 1 | 5 | 0000 0000 |
| F | 0 | 7 | F | 0 | 8 | 1 | 5 | 0000 1100 |
| F | 0 | 8 | 0 | 1 | 0 | 1 | 5 | 0000 0110 |
| F | 0 | 8 | 1 | 1 | 8 | 1 | 5 | 0000 0000 |
| F | 0 | 8 | 2 | 2 | 0 | 1 | 5 | 0000 0000 |
| F | 0 | 8 | 3 | 2 | 8 | 1 | 5 | 0000 0011 |
| F | 0 | 8 | 4 | 0 | 0 | 1 | 6 | 0000 0000 |
| F | 0 | 8 | 5 | 0 | 8 | 1 | 6 | 0000 1110 |
| F | 0 | 8 | 6 | 1 | 0 | 1 | 6 | 0001 1100 |

TABLE 1d

| MEMORY ADDRESS | | | | COORDINATE X | | COORDINATE Y | | DATA |
|---|---|---|---|---|---|---|---|---|
| F | 0 | 8 | 7 | 1 | 8 | 1 | 6 | 0000 0000 |
| F | 0 | 8 | 8 | 2 | 0 | 1 | 6 | 0000 0000 |
| F | 0 | 8 | 9 | 2 | 8 | 1 | 6 | 0110 0000 |
| F | 0 | 8 | A | 0 | 0 | 1 | 7 | 0000 0000 |
| F | 0 | 8 | B | 0 | 8 | 1 | 7 | 0000 0011 |
| F | 0 | 8 | C | 1 | 0 | 1 | 7 | 1111 0000 |
| F | 0 | 8 | D | 1 | 8 | 1 | 7 | 0000 0000 |
| F | 0 | 8 | E | 2 | 0 | 1 | 7 | 0000 0000 |
| F | 0 | 8 | F | 2 | 8 | 1 | 7 | 0000 0000 |
| F | 0 | 9 | 0 | 0 | 0 | 1 | 8 | 0000 0000 |
| F | 0 | 9 | 1 | 0 | 8 | 1 | 8 | 0000 0000 |
| F | 0 | 9 | 2 | 1 | 0 | 1 | 8 | 0000 0000 |
| F | 0 | 9 | 3 | 1 | 8 | 1 | 8 | 0000 0000 |
| F | 0 | 9 | 4 | 2 | 0 | 1 | 8 | 0000 0000 |
| F | 0 | 9 | 5 | 2 | 8 | 1 | 8 | 0000 0000 |
| F | 0 | 9 | 6 | 0 | 0 | 1 | 9 | 0000 0000 |
| F | 0 | 9 | 7 | 0 | 8 | 1 | 9 | 0000 0000 |
| F | 0 | 9 | 8 | 1 | 0 | 1 | 9 | 0000 0000 |
| F | 0 | 9 | 9 | 1 | 8 | 1 | 9 | 0000 0000 |
| F | 0 | 9 | A | 2 | 0 | 1 | 9 | 0000 0000 |
| F | 0 | 9 | B | 2 | 8 | 1 | 9 | 0000 0000 |
| F | 0 | 9 | C | 0 | 0 | 1 | A | 0000 0000 |
| F | 0 | 9 | D | 0 | 8 | 1 | A | 0000 0000 |
| F | 0 | 9 | E | 1 | 0 | 1 | A | 0000 0000 |
| F | 0 | 9 | F | 1 | 8 | 1 | A | 0000 0000 |
| F | 0 | A | 0 | 2 | 0 | 1 | A | 0000 0000 |

TABLE 1d-continued

| MEMORY ADDRESS | | | | COORDINATE X | | COORDINATE Y | | DATA |
|---|---|---|---|---|---|---|---|---|
| F | 0 | A | 1 | 2 | 8 | 1 | A | 0000 0000 |
| F | 0 | A | 2 | 0 | 0 | 1 | B | 0000 0000 |
| F | 0 | A | 3 | 0 | 8 | 1 | B | 0000 0000 |
| F | 0 | A | 4 | 1 | 0 | 1 | B | 0000 0000 |
| F | 0 | A | 5 | 1 | 8 | 1 | B | 0000 0000 |
| F | 0 | A | 6 | 2 | 0 | 1 | B | 0000 0000 |
| F | 0 | A | 7 | 2 | 8 | 1 | B | 0000 0000 |
| F | 0 | A | 8 | 0 | 0 | 1 | C | 0000 0000 |
| F | 0 | A | 9 | 0 | 8 | 1 | C | 0000 0000 |
| F | 0 | A | A | 1 | 0 | 1 | C | 0000 0000 |
| F | 0 | A | B | 1 | 8 | 1 | C | 0000 0000 |
| F | 0 | A | C | 2 | 0 | 1 | C | 0000 0000 |
| F | 0 | A | D | 2 | 8 | 1 | C | 0000 0000 |

Figure 11:
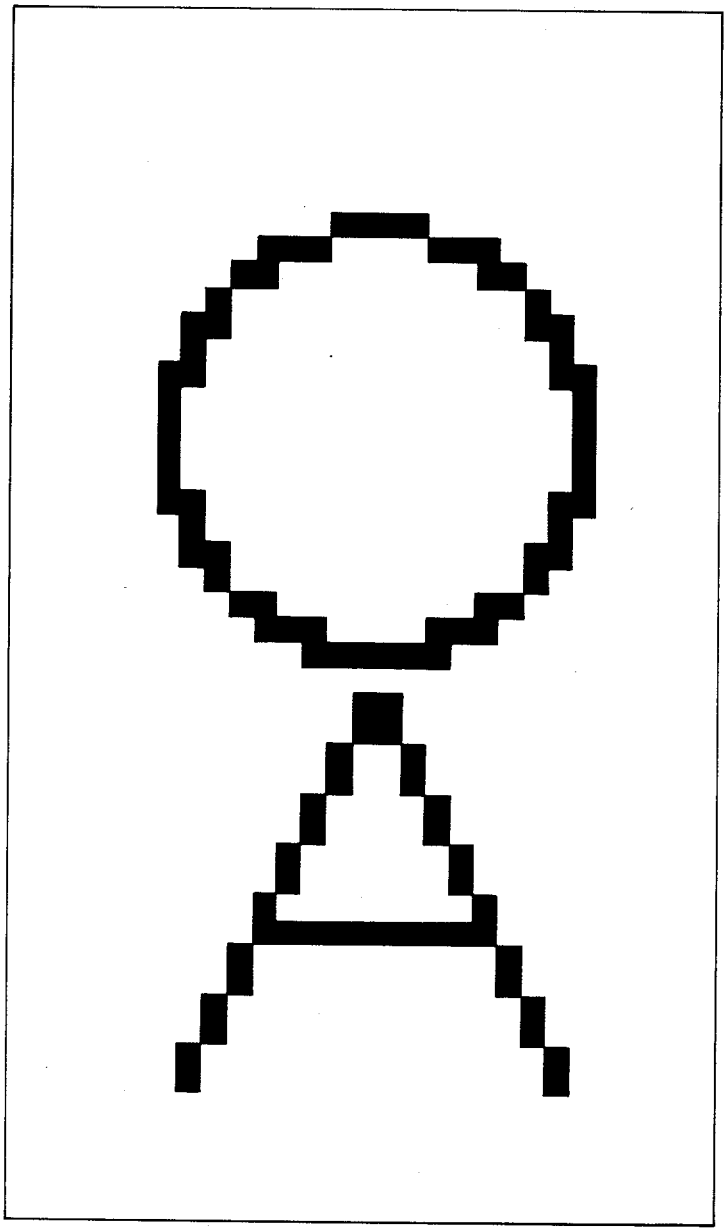
FIG. 11 is an illustration showing a sample of the formed image in the writing mode.

Then, a copy image is obtained as shown in FIG. 11, when a write process is performed in accordance with this pattern table.

When the P flag equals zero (0), the routine continues to step S208, and the coordinates used for the edited copy (erasure or trimming) is stored as two points (until n=2 is reached) in steps S210 and S212. The reason that n equals two (2) in the present embodiment, is that in order to designate the edited copy region as a quadrilateral, the designation of the coordinates of both ends of the diagonal line for said quadrilateral is sufficient.

Figure 12:
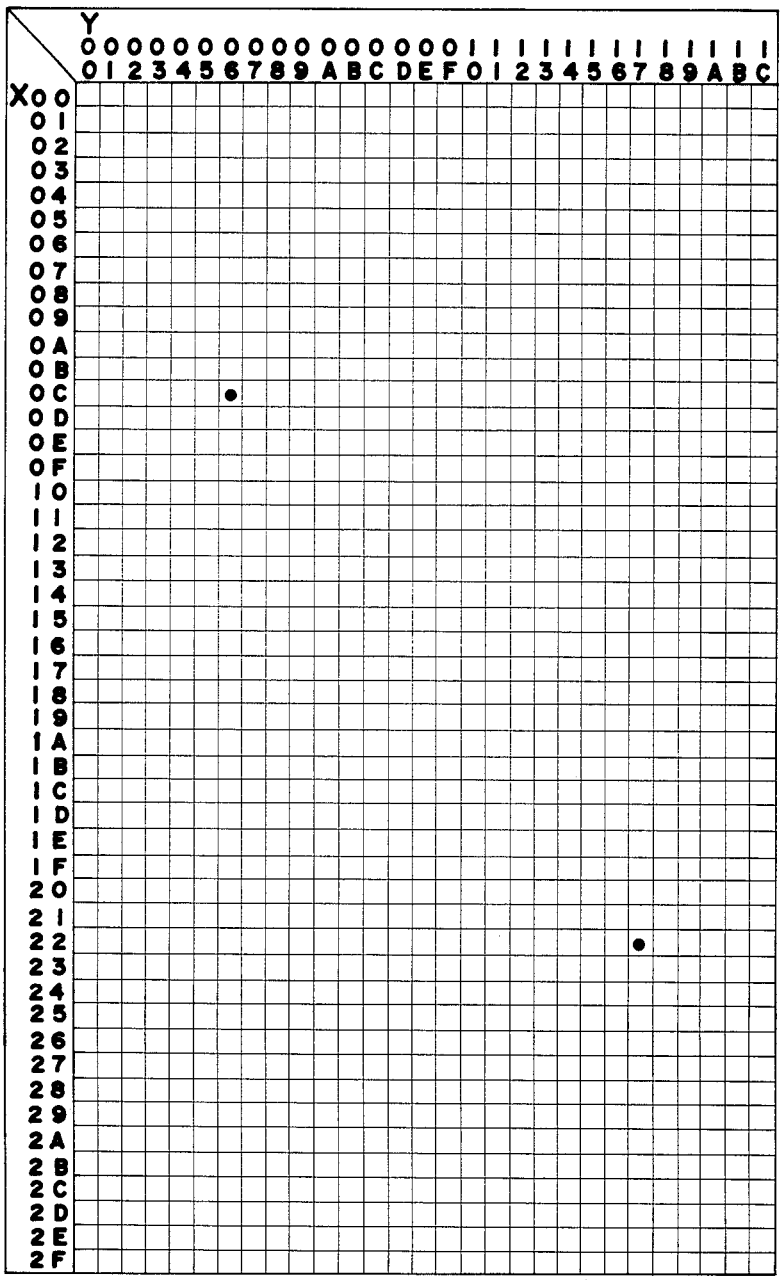
FIGS. 12 and 13 are illustrations showing the area input operation and the area.

When, for example, the coordinates (0,C) and (22,17) are pressed on tablet 910 using stylus 950, as shown in FIG. 12, an erasure table is formed shown in Tables 2a to 2d in memory 624.

TABLE 2a

| MEMORY ADDRESS | | | | COORDINATE X | | COORDINATE Y | | DATA |
|---|---|---|---|---|---|---|---|---|
| F | 0 | 0 | 0 | 0 | 0 | 0 | 0 | 0000 0000 |
| F | 0 | 0 | 1 | 0 | 8 | 0 | 0 | 0000 0000 |
| F | 0 | 0 | 2 | 1 | 0 | 0 | 0 | 0000 0000 |
| F | 0 | 0 | 3 | 1 | 8 | 0 | 0 | 0000 0000 |
| F | 0 | 0 | 4 | 2 | 0 | 0 | 0 | 0000 0000 |
| F | 0 | 0 | 5 | 2 | 8 | 0 | 0 | 0000 0000 |
| F | 0 | 0 | 6 | 0 | 0 | 0 | 1 | 0000 0000 |
| F | 0 | 0 | 7 | 0 | 8 | 0 | 1 | 0000 0000 |
| F | 0 | 0 | 8 | 1 | 0 | 0 | 1 | 0000 0000 |
| F | 0 | 0 | 9 | 1 | 8 | 0 | 1 | 0000 0000 |
| F | 0 | 0 | A | 2 | 0 | 0 | 1 | 0000 0000 |
| F | 0 | 0 | B | 2 | 8 | 0 | 1 | 0000 0000 |
| F | 0 | 0 | C | 0 | 0 | 0 | 2 | 0000 0000 |
| F | 0 | 0 | D | 0 | 8 | 0 | 2 | 0000 0000 |
| F | 0 | 0 | E | 1 | 0 | 0 | 2 | 0000 0000 |
| F | 0 | 0 | F | 1 | 8 | 0 | 2 | 0000 0000 |
| F | 0 | 1 | 0 | 2 | 0 | 0 | 2 | 0000 0000 |
| F | 0 | 1 | 1 | 2 | 8 | 0 | 2 | 0000 0000 |
| F | 0 | 1 | 2 | 0 | 0 | 0 | 3 | 0000 0000 |
| F | 0 | 1 | 3 | 0 | 8 | 0 | 3 | 0000 0000 |
| F | 0 | 1 | 4 | 1 | 0 | 0 | 3 | 0000 0000 |
| F | 0 | 1 | 5 | 1 | 8 | 0 | 3 | 0000 0000 |
| F | 0 | 1 | 6 | 2 | 0 | 0 | 3 | 0000 0000 |
| F | 0 | 1 | 7 | 2 | 8 | 0 | 3 | 0000 0000 |
| F | 0 | 1 | 8 | 0 | 0 | 0 | 4 | 0000 0000 |
| F | 0 | 1 | 9 | 0 | 8 | 0 | 4 | 0000 0000 |
| F | 0 | 1 | A | 1 | 0 | 0 | 4 | 0000 0000 |
| F | 0 | 1 | B | 1 | 8 | 0 | 4 | 0000 0000 |
| F | 0 | 1 | C | 2 | 0 | 0 | 4 | 0000 0000 |
| F | 0 | 1 | D | 2 | 8 | 0 | 4 | 0000 0000 |
| F | 0 | 1 | E | 0 | 0 | 0 | 5 | 0000 0000 |
| F | 0 | 1 | F | 0 | 8 | 0 | 5 | 0000 0000 |
| F | 0 | 2 | 0 | 1 | 0 | 0 | 5 | 0000 0000 |
| F | 0 | 2 | 1 | 1 | 8 | 0 | 5 | 0000 0000 |
| F | 0 | 2 | 2 | 2 | 0 | 0 | 5 | 0000 0000 |
| F | 0 | 2 | 3 | 2 | 8 | 0 | 5 | 0000 0000 |
| F | 0 | 2 | 4 | 0 | 0 | 0 | 6 | 0000 0000 |
| F | 0 | 2 | 5 | 0 | 8 | 0 | 6 | 0000 1111 |
| F | 0 | 2 | 6 | 1 | 0 | 0 | 6 | 1111 1111 |

TABLE 2a-continued

| MEMORY ADDRESS | | | | COORDINATE X | | COORDINATE Y | | DATA |
|---|---|---|---|---|---|---|---|---|
| F | 0 | 2 | 7 | 1 | 8 | 0 | 6 | 1111 1111 |
| F | 0 | 2 | 8 | 2 | 0 | 0 | 6 | 1110 0000 |
| F | 0 | 2 | 9 | 2 | 8 | 0 | 6 | 0000 0000 |
| F | 0 | 2 | A | 0 | 0 | 0 | 7 | 0000 0000 |
| F | 0 | 2 | B | 0 | 8 | 0 | 7 | 0000 1111 |
| F | 0 | 2 | C | 1 | 0 | 0 | 7 | 1111 1111 |

TABLE 2b

| MEMORY ADDRESS | | | | COORDINATE X | | COORDINATE Y | | DATA |
|---|---|---|---|---|---|---|---|---|
| F | 0 | 2 | D | 1 | 8 | 0 | 7 | 1111 1111 |
| F | 0 | 2 | E | 2 | 0 | 0 | 7 | 1110 0000 |
| F | 0 | 2 | F | 2 | 8 | 0 | 7 | 0000 0000 |
| F | 0 | 3 | 0 | 0 | 0 | 0 | 8 | 0000 0000 |
| F | 0 | 3 | 1 | 0 | 8 | 0 | 8 | 0000 1111 |
| F | 0 | 3 | 2 | 1 | 0 | 0 | 8 | 1111 1111 |
| F | 0 | 3 | 3 | 1 | 8 | 0 | 8 | 1111 1111 |
| F | 0 | 3 | 4 | 2 | 0 | 0 | 8 | 1110 0000 |
| F | 0 | 3 | 5 | 2 | 8 | 0 | 8 | 0000 0000 |
| F | 0 | 3 | 6 | 0 | 0 | 0 | 9 | 0000 0000 |
| F | 0 | 3 | 7 | 0 | 8 | 0 | 9 | 0000 1111 |
| F | 0 | 3 | 8 | 1 | 0 | 0 | 9 | 1111 1111 |
| F | 0 | 3 | 9 | 1 | 8 | 0 | 9 | 1111 1111 |
| F | 0 | 3 | A | 2 | 0 | 0 | 9 | 1110 0000 |
| F | 0 | 3 | B | 2 | 8 | 0 | 9 | 0000 0000 |
| F | 0 | 3 | C | 0 | 0 | 0 | A | 0000 0000 |
| F | 0 | 3 | D | 0 | 8 | 0 | A | 0000 1111 |
| F | 0 | 3 | E | 1 | 0 | 0 | A | 1111 1111 |
| F | 0 | 3 | F | 1 | 8 | 0 | A | 1111 1111 |
| F | 0 | 4 | 0 | 2 | 0 | 0 | A | 1110 0000 |
| F | 0 | 4 | 1 | 2 | 8 | 0 | A | 0000 0000 |
| F | 0 | 4 | 2 | 0 | 0 | 0 | B | 0000 0000 |
| F | 0 | 4 | 3 | 0 | 8 | 0 | B | 0000 1111 |
| F | 0 | 4 | 4 | 1 | 0 | 0 | B | 1111 1111 |
| F | 0 | 4 | 5 | 1 | 8 | 0 | B | 1111 1111 |
| F | 0 | 4 | 6 | 2 | 0 | 0 | B | 1110 0000 |
| F | 0 | 4 | 7 | 2 | 8 | 0 | B | 0000 0000 |
| F | 0 | 4 | 8 | 0 | 0 | 0 | C | 0000 0000 |
| F | 0 | 4 | 9 | 0 | 8 | 0 | C | 0000 1111 |
| F | 0 | 4 | A | 1 | 0 | 0 | C | 1111 1111 |
| F | 0 | 4 | B | 1 | 8 | 0 | C | 1111 1111 |
| F | 0 | 4 | C | 2 | 0 | 0 | C | 1110 0000 |
| F | 0 | 4 | D | 2 | 8 | 0 | C | 0000 0000 |
| F | 0 | 4 | E | 0 | 0 | 0 | D | 0000 0000 |
| F | 0 | 4 | F | 0 | 8 | 0 | D | 0000 1111 |
| F | 0 | 5 | 0 | 1 | 0 | 0 | D | 1111 1111 |
| F | 0 | 5 | 1 | 1 | 8 | 0 | D | 1111 1111 |
| F | 0 | 5 | 2 | 2 | 0 | 0 | D | 1110 0000 |
| F | 0 | 5 | 3 | 2 | 8 | 0 | D | 0000 0000 |
| F | 0 | 5 | 4 | 0 | 0 | 0 | E | 0000 0000 |
| F | 0 | 5 | 5 | 0 | 8 | 0 | E | 0000 1111 |
| F | 0 | 5 | 6 | 1 | 0 | 0 | E | 1111 1111 |
| F | 0 | 5 | 7 | 1 | 8 | 0 | E | 1111 1111 |
| F | 0 | 5 | 8 | 2 | 0 | 0 | E | 1110 0000 |
| F | 0 | 5 | 9 | 2 | 8 | 0 | E | 0000 0000 |

TABLE 2c

| MEMORY ADDRESS | | | | COORDINATE X | | COORDINATE Y | | DATA |
|---|---|---|---|---|---|---|---|---|
| F | 0 | 5 | A | 0 | 0 | 0 | F | 0000 0000 |
| F | 0 | 5 | B | 0 | 8 | 0 | F | 0000 1111 |
| F | 0 | 5 | C | 1 | 0 | 0 | F | 1111 1111 |
| F | 0 | 5 | D | 1 | 8 | 0 | F | 1111 1111 |
| F | 0 | 5 | E | 2 | 0 | 0 | F | 1110 0000 |
| F | 0 | 5 | F | 2 | 8 | 0 | F | 0000 0000 |
| F | 0 | 6 | 0 | 0 | 0 | 1 | 0 | 0000 0000 |
| F | 0 | 6 | 1 | 0 | 8 | 1 | 0 | 0000 1111 |
| F | 0 | 6 | 2 | 1 | 0 | 1 | 0 | 1111 1111 |
| F | 0 | 6 | 3 | 1 | 8 | 1 | 0 | 1111 1111 |
| F | 0 | 6 | 4 | 2 | 0 | 1 | 0 | 1110 0000 |
| F | 0 | 6 | 5 | 2 | 8 | 1 | 0 | 0000 0000 |

TABLE 2c-continued

| MEMORY ADDRESS | | | | COORDINATE X | | COORDINATE Y | | DATA |
|---|---|---|---|---|---|---|---|---|
| F | 0 | 6 | 6 | 0 | 0 | 1 | 1 | 0000 0000 |
| F | 0 | 6 | 7 | 0 | 8 | 1 | 1 | 0000 1111 |
| F | 0 | 6 | 8 | 1 | 0 | 1 | 1 | 1111 1111 |
| F | 0 | 6 | 9 | 1 | 8 | 1 | 1 | 1111 1111 |
| F | 0 | 6 | A | 2 | 0 | 1 | 1 | 1110 0000 |
| F | 0 | 6 | B | 2 | 8 | 1 | 1 | 0000 0000 |
| F | 0 | 6 | C | 0 | 0 | 1 | 2 | 0000 0000 |
| F | 0 | 6 | D | 0 | 8 | 1 | 2 | 0000 1111 |
| F | 0 | 6 | E | 1 | 0 | 1 | 2 | 1111 1111 |
| F | 0 | 6 | F | 1 | 8 | 1 | 2 | 1111 1111 |
| F | 0 | 7 | 0 | 2 | 0 | 1 | 2 | 1110 0000 |
| F | 0 | 7 | 1 | 2 | 8 | 1 | 2 | 0000 0000 |
| F | 0 | 7 | 2 | 0 | 0 | 1 | 3 | 0000 0000 |
| F | 0 | 7 | 3 | 0 | 8 | 1 | 3 | 0000 1111 |
| F | 0 | 7 | 4 | 1 | 0 | 1 | 3 | 1111 1111 |
| F | 0 | 7 | 5 | 1 | 8 | 1 | 3 | 1111 1111 |
| F | 0 | 7 | 6 | 2 | 0 | 1 | 3 | 1110 0000 |
| F | 0 | 7 | 7 | 2 | 8 | 1 | 3 | 0000 0000 |
| F | 0 | 7 | 8 | 0 | 0 | 1 | 4 | 0000 0000 |
| F | 0 | 7 | 9 | 0 | 8 | 1 | 4 | 0000 1111 |
| F | 0 | 7 | A | 1 | 0 | 1 | 4 | 1111 1111 |
| F | 0 | 7 | B | 1 | 8 | 1 | 4 | 1111 1111 |
| F | 0 | 7 | C | 2 | 0 | 1 | 4 | 1110 0000 |
| F | 0 | 7 | D | 2 | 8 | 1 | 4 | 0000 0000 |
| F | 0 | 7 | E | 0 | 0 | 1 | 5 | 0000 0000 |
| F | 0 | 7 | F | 0 | 8 | 1 | 5 | 0000 1111 |
| F | 0 | 8 | 0 | 1 | 0 | 1 | 5 | 1111 1111 |
| F | 0 | 8 | 1 | 1 | 8 | 1 | 5 | 1111 1111 |
| F | 0 | 8 | 2 | 2 | 0 | 1 | 5 | 1110 0000 |
| F | 0 | 8 | 3 | 2 | 8 | 1 | 5 | 0000 0000 |
| F | 0 | 8 | 4 | 0 | 0 | 1 | 6 | 0000 0000 |
| F | 0 | 8 | 5 | 0 | 8 | 1 | 6 | 0000 1111 |
| F | 0 | 8 | 6 | 1 | 0 | 1 | 6 | 1111 1111 |

TABLE 2d

| MEMORY ADDRESS | | | | COORDINATE X | | COORDINATE Y | | DATA |
|---|---|---|---|---|---|---|---|---|
| F | 0 | 8 | 7 | 1 | 8 | 1 | 6 | 1111 1111 |
| F | 0 | 8 | 8 | 2 | 0 | 1 | 6 | 1110 0000 |
| F | 0 | 8 | 9 | 2 | 8 | 1 | 6 | 0000 0000 |
| F | 0 | 8 | A | 0 | 0 | 1 | 7 | 0000 0000 |
| F | 0 | 8 | B | 0 | 8 | 1 | 7 | 0000 1111 |
| F | 0 | 8 | C | 1 | 0 | 1 | 7 | 1111 1111 |
| F | 0 | 8 | D | 1 | 8 | 1 | 7 | 1111 1111 |
| F | 0 | 8 | E | 2 | 0 | 1 | 7 | 1110 0000 |
| F | 0 | 8 | F | 2 | 8 | 1 | 7 | 0000 0000 |
| F | 0 | 9 | 0 | 0 | 0 | 1 | 8 | 0000 0000 |
| F | 0 | 9 | 1 | 0 | 8 | 1 | 8 | 0000 0000 |
| F | 0 | 9 | 2 | 1 | 0 | 1 | 8 | 0000 0000 |
| F | 0 | 9 | 3 | 1 | 8 | 1 | 8 | 0000 0000 |
| F | 0 | 9 | 4 | 2 | 0 | 1 | 8 | 0000 0000 |
| F | 0 | 9 | 5 | 2 | 8 | 1 | 8 | 0000 0000 |
| F | 0 | 9 | 6 | 0 | 0 | 1 | 9 | 0000 0000 |
| F | 0 | 9 | 7 | 0 | 8 | 1 | 9 | 0000 0000 |
| F | 0 | 9 | 8 | 1 | 0 | 1 | 9 | 0000 0000 |
| F | 0 | 9 | 9 | 1 | 8 | 1 | 9 | 0000 0000 |
| F | 0 | 9 | A | 2 | 0 | 1 | 9 | 0000 0000 |
| F | 0 | 9 | B | 2 | 8 | 1 | 9 | 0000 0000 |
| F | 0 | 9 | C | 0 | 0 | 1 | A | 0000 0000 |
| F | 0 | 9 | D | 0 | 8 | 1 | A | 0000 0000 |
| F | 0 | 9 | E | 1 | 0 | 1 | A | 0000 0000 |
| F | 0 | 9 | F | 1 | 8 | 1 | A | 0000 0000 |
| F | 0 | A | 0 | 2 | 0 | 1 | A | 0000 0000 |
| F | 0 | A | 1 | 2 | 8 | 1 | A | 0000 0000 |
| F | 0 | A | 2 | 0 | 0 | 1 | B | 0000 0000 |
| F | 0 | A | 3 | 0 | 8 | 1 | B | 0000 0000 |
| F | 0 | A | 4 | 1 | 0 | 1 | B | 0000 0000 |
| F | 0 | A | 5 | 1 | 8 | 1 | B | 0000 0000 |
| F | 0 | A | 6 | 2 | 0 | 1 | B | 0000 0000 |
| F | 0 | A | 7 | 2 | 8 | 1 | B | 0000 0000 |
| F | 0 | A | 8 | 0 | 0 | 1 | C | 0000 0000 |
| F | 0 | A | 9 | 0 | 8 | 1 | C | 0000 0000 |
| F | 0 | A | A | 1 | 0 | 1 | C | 0000 0000 |
| F | 0 | A | B | 1 | 8 | 1 | C | 0000 0000 |
| F | 0 | A | C | 2 | 0 | 1 | C | 0000 0000 |

TABLE 2d-continued

| MEMORY ADDRESS | | | | COORDINATE X | | COORDINATE Y | | DATA |
|---|---|---|---|---|---|---|---|---|
| F | 0 | A | D | 2 | 8 | 1 | C | 0000 0000 |

Figure 13:
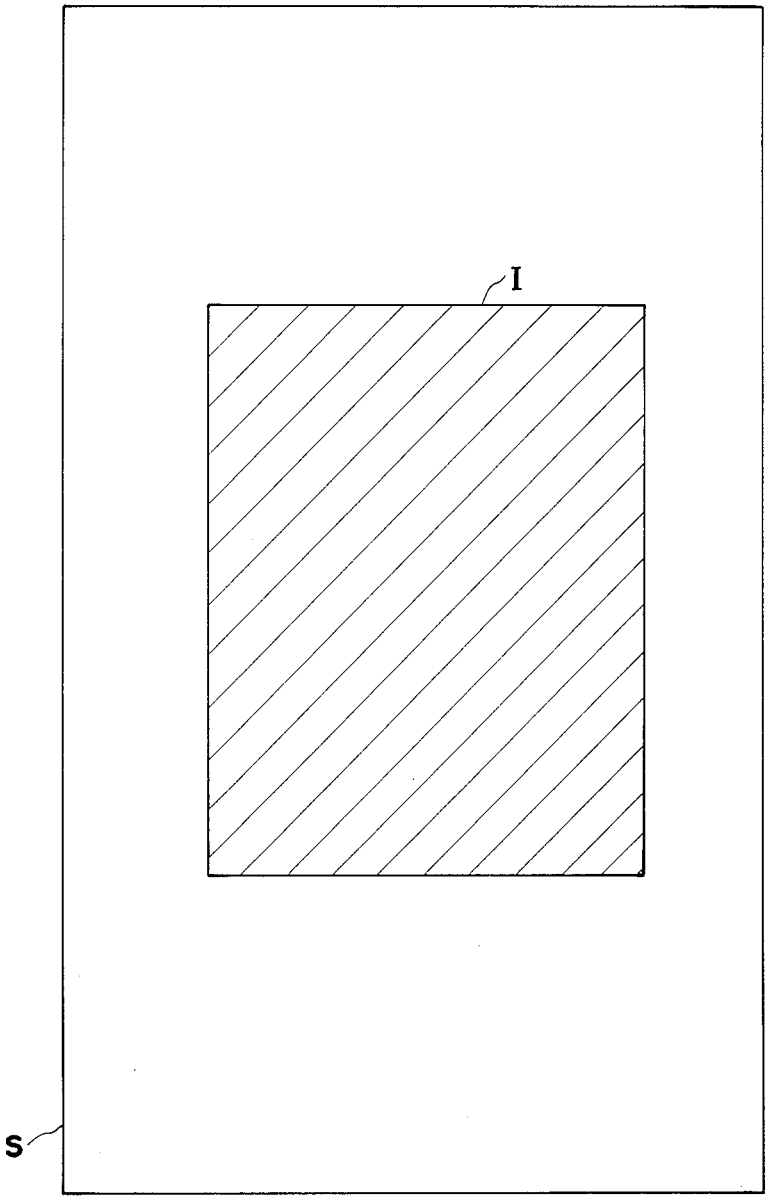

When a copy operation is performed in the trimming mode in accordance with the aforesaid erasure table, the image is formed on the shaded area I of copy paper S, as shown in FIG. 13. In the erase mode, however, the shaded area I of copy paper S becomes blank and the image is formed in the remaining region.

The routine continues from step S212 through S214, and an erasure table is formed using the ON/OFF status of each LED component of eraser 4 based on the aforesaid coordinate data, and this table is then stored in memory (S216).

As per the above description, an LED component ON/OFF table is created via the input coordinate data.

Furthermore, although not discussed in regard to the present embodiment, when the copy magnification is modified, a common magnification modifying means may be used in combination with the present embodiment.

What is claimed is:

1. A copying apparatus comprising:

means for supporting an original document thereon;

a photosensitive member;

first image forming means for forming an image of the original document on said photosensitive member;

means for manually inputting a plurality of subjectively determined coordinate data to define positions on said photosensitive member;

second image forming means for forming a dot image at each of the defined positions on said photosensitive member without operating said first image forming means, the aggregation of each of said dot images on the defined positions resulting in a pattern image; and means for transferring said original document image and said pattern image onto the same surface of a single copy sheet.

2. A copying apparatus as claimed in claim 1, wherein said pattern image forming means includes a plurality of light-emitting diodes each of which is operated independently.

3. A copying apparatus as claimed in claim 1, further comprising means for erasing a specific area of the image on the photosensitive member, said specific area being defined by the input coordinates data.

4. A copying apparatus capable of copying in simplex mode in which a single operation is executed for every copy sheet and in composite mode in which plural copy operations are executed for every copy sheet said copying apparatus comprising:

first select means for selecting one of a simplex mode and a composite mode;

means for supporting an original document thereon;

first image forming means for forming an image of the original document;

means for inputting arbitrary patterns;

second image forming means for forming an image of input patterns;

second select means for selecting a specific mode in which said second image forming means operates; and control means for selecting the composite mode, irrespective of said first select means, in response to the selection of the specific mode by said second select means.

5. A copying apparatus as claimed in claim 4, wherein said second image forming means includes a plurality of light-emitting diodes each of which is operated independently.

6. A copying apparatus as claimed in claim 4, wherein said first image forming means includes an illuminating member for illuminating the original document on the support means.

7. A copying apparatus as claimed in claim 6, wherein said control means inhibits the operation of said illuminating member in response to the selection of said second image forming means.

8. A copying apparatus as claimed in claim 4, further comprising means for cancelling the composite mode selected by said control means.

9. A copying apparatus comprising:

means for supporting an original document thereon;

first image forming means for forming an image of the original document on a surface of a copy sheet;

means for manually inputting a plurality of subjectively determined coordinate data to define predetermined positions on the copy sheet; and second image forming means for forming a dot image on each of the defined positions on the same surface of copy sheet, the aggregation of each of said dot images on the respective defined positions resulting in a pattern image.

10. An image forming apparatus comprising:

a photosensitive member;

means for manually inputting a plurality of arbitrary coordinate data to define positions on said photosensitive member;

means for forming a dot image on each of the defined positions on said photosensitive member, the aggregation of each dot image on the defined positions resulting in a pattern image; and means for transferring said pattern image onto a surface of a copy sheet.

11. A copying apparatus as claimed in claim 9, wherein said first image forming means forms the image of the original document after the image formation of the second image forming means.

* * * * *